US006381776B1

(12) United States Patent
Wang

(10) Patent No.: US 6,381,776 B1
(45) Date of Patent: May 7, 2002

(54) LOCATING STRUCTURE OF WATER MIXING BOLT OF LAVATORY FAUCET

(76) Inventor: Shih-Ming Wang, P.O. Box 453, Taichung (TW)

( * ) Notice: Subject to any disclaimer, the term of this patent is extended or adjusted under 35 U.S.C. 154(b) by 0 days.

(21) Appl. No.: 09/877,061

(22) Filed: Jun. 11, 2001

(51) Int. Cl.[7] ..... E03C 1/042
(52) U.S. Cl. ..... 4/695; 4/676; 137/801
(58) Field of Search ..... 4/675–678, 695; 137/359, 360, 801

(56) References Cited

U.S. PATENT DOCUMENTS 4,553,277 A * 11/1985 Duncan ..... 137/359
6,073,972 A * 6/2000 Rivera ..... 137/801
6,256,810 B1 * 7/2001 Baker ..... 4/678
6,301,728 B1 * 10/2001 Pilatowicz et al. ..... 137/360

* cited by examiner

*Primary Examiner*—Charles E. Phillips

(57) ABSTRACT

A lavatory faucet comprises a water mixing bolt seat, a locating plate, a water mixing bolt tube, a locating bolt, and a faucet neck. The water mixing bolt seat is connected with a cold water control valve and a hot water control valve. The water mixing bolt tube is securely mounted on the water mixing bolt seat in conjunction with the locating plate and the locating bolt. The locating plate is pressed against the lavatory basin. The locating bolt enables the inner end of the faucet neck to be located securely on a support plate of the water mixing bolt seat.

1 Claim, 4 Drawing Sheets

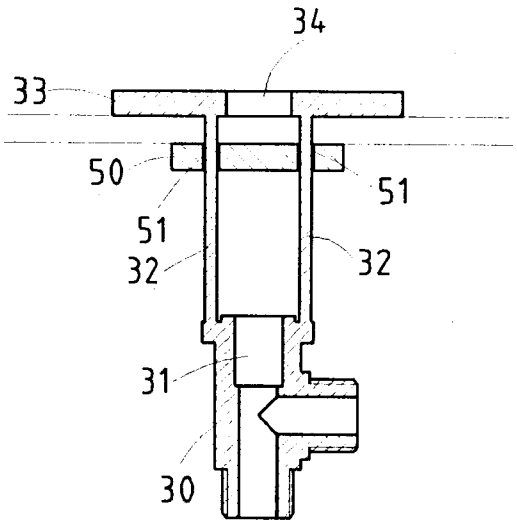
FIG. 4-B
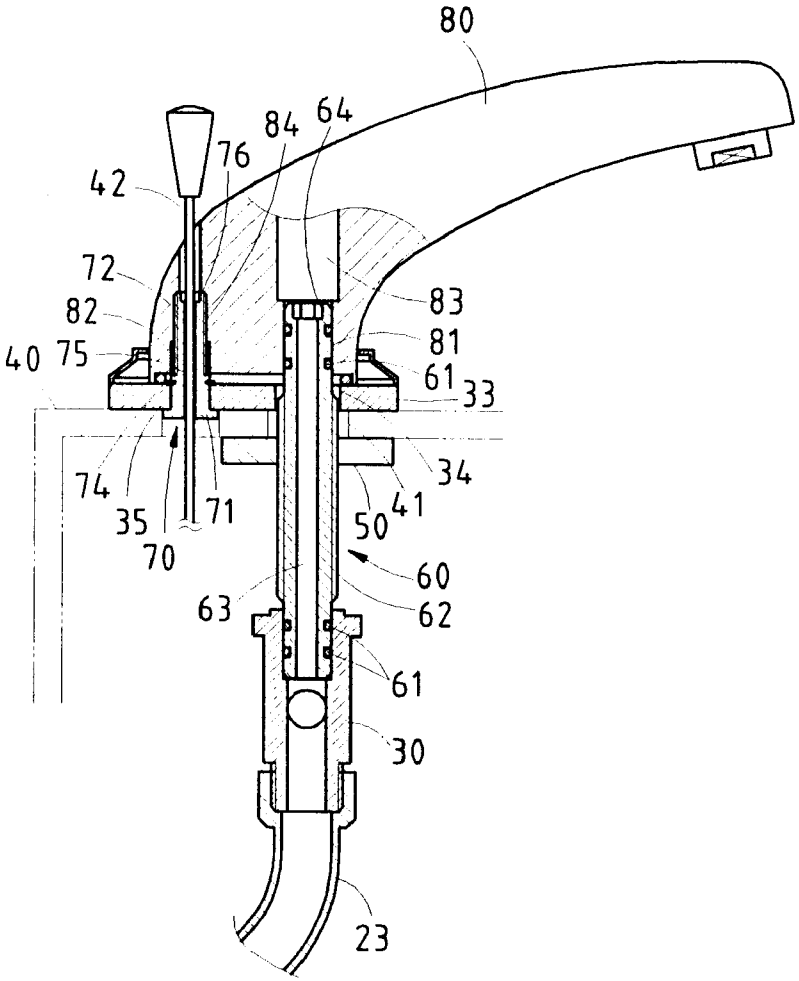
FIG. 4-A

LOCATING STRUCTURE OF WATER MIXING BOLT OF LAVATORY FAUCET

BACKGROUND OF THE INVENTION

1. Field of the Invention

The present invention relates generally to a lavatory faucet, and more particularly to a structure for locating a water mixing bolt of the lavatory faucet.

2. Description of Related Art

As shown in FIG. 1, a prior art faucet 10 comprises a water mixing bolt tube 11 which is put through an assembly hole 13 of the lavatory 12 to be connected with a top tube 17 of a three-way pipe 16 fastened between a cold water control valve 14 and a hot water control valve 15. The water mixing bolt tube 11 is fixed by a locking ring 18 which is located under the lavatory 12 and is therefore difficult to reach to facilitate the repairing of the prior art faucet 10.

BRIEF SUMMARY OF THE INVENTION

The primary objective of the present invention is to provide a structure for locating a water mixing bolt of the lavatory faucet.

In keeping with the principle of the present invention, the foregoing objective of the present invention is attained by a faucet comprising a water mixing bolt seat which is located between a cold water control valve and a hot water control valve and is provided at the top end with two ribs and a support plate disposed on the ribs. The support plate is provided with to through holes. The two ribs are provided with a locating plate. The water mixing bolt tube is located by the locating plate which is pressed against the lavatory.

The features and functions of the present invention will be more readily understood upon a thoughtful deliberation of the following detailed description of the present invention with reference to the accompanying drawings.

BRIEF DESCRIPTION OF THE SEVERAL VIEWS OF THE DRAWINGS

FIG. 4A shows a sectional schematic view of the present invention in combination.

FIG. 4B shows an auxiliary view of FIG. 4A.

DETAILED DESCRIPTION OF THE INVENTION

Figure 1:
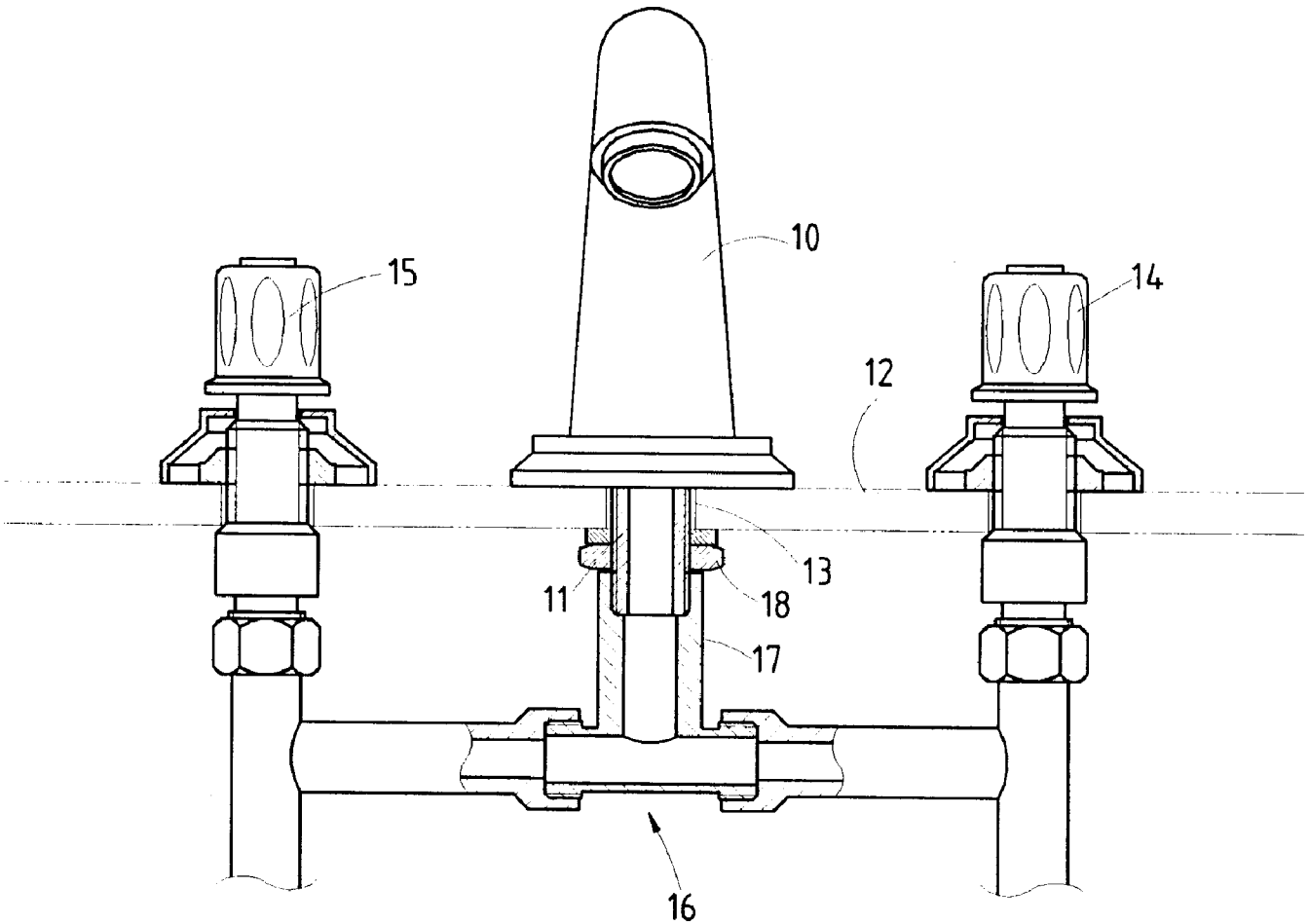
FIG. 1 PRIOR ART
FIG. 1 shows a sectional schematic view of a faucet of the prior art.
Figure 2:
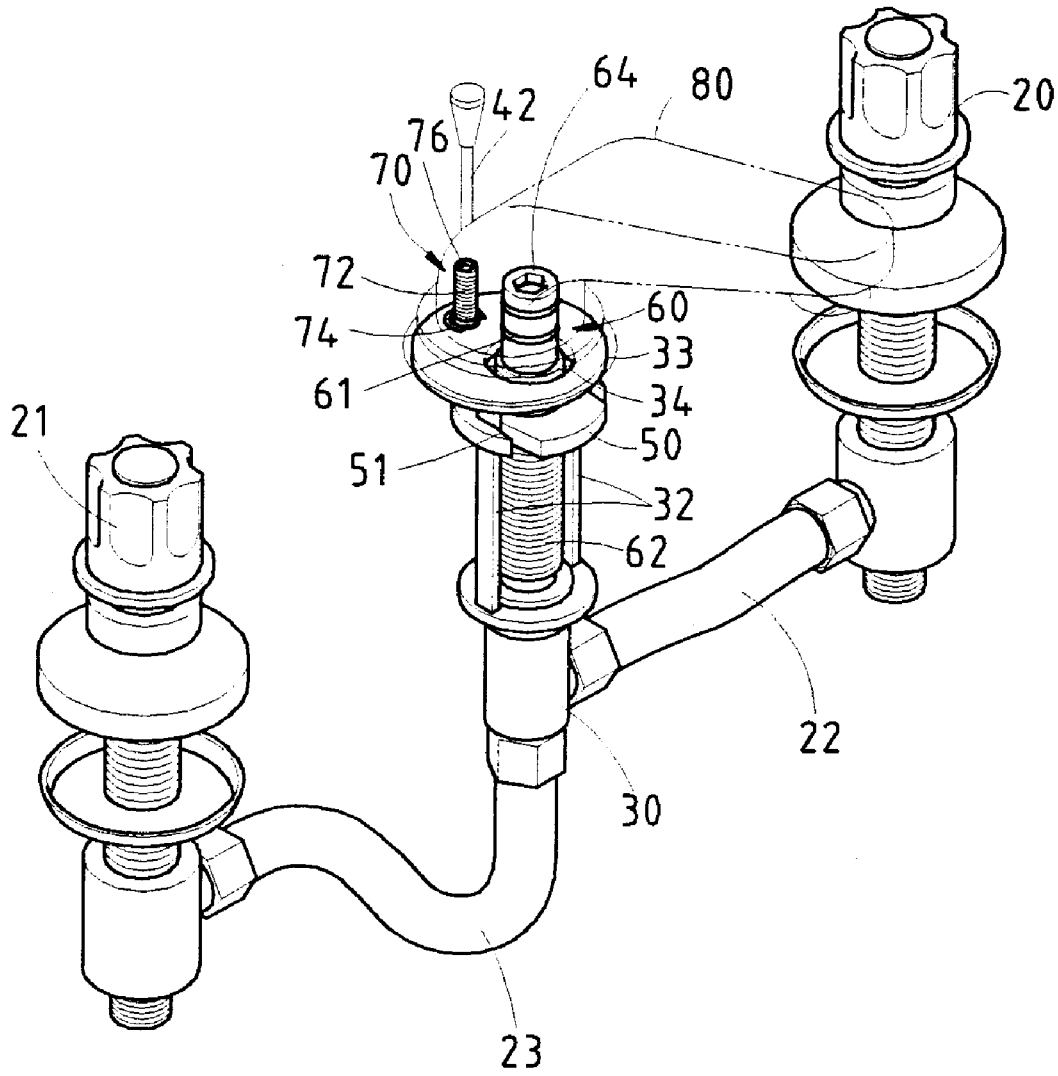
FIG. 2 shows a perspective view of the present invention.
Figure 3:
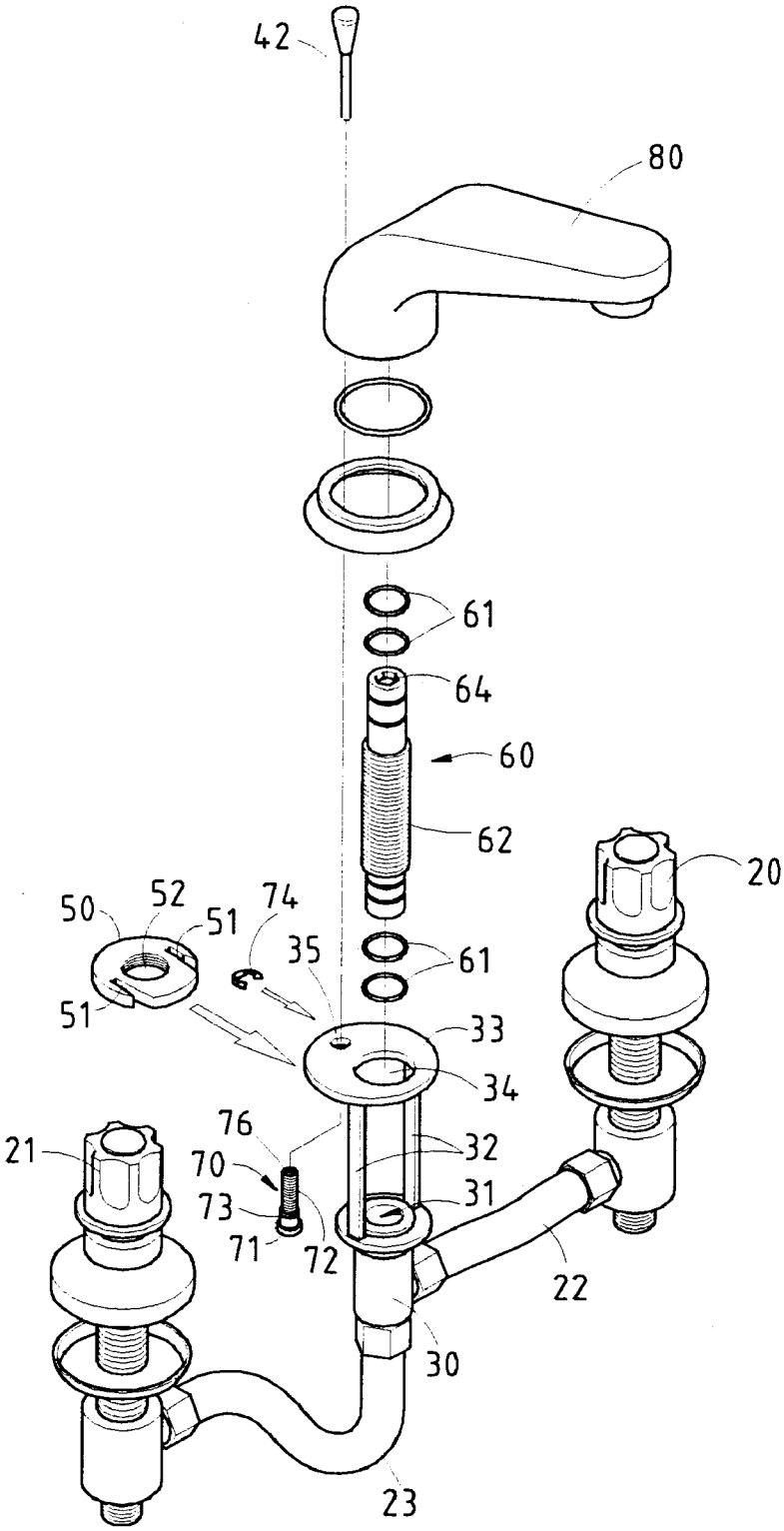
FIG. 3 shows an exploded view of the present invention.

As shown in FIGS. 2, 3, 4A, and 4B, a lavatory faucet of the present invention comprises a cold water control valve 20, a hot water control valve 21, a water mixing bolt seat 30, a locating plate 50, a water mixing bolt tube 60, a locating bolt 70, and a faucet neck 80.

The water mixing bolt seat 30 is located between the cold water control valve 20 and the hot water control valve 21 such that the water mixing bolt seat 30 is in communication with the valves 20 and 21 by a cold water pipe 22 and a hot water pipe 23. The seat 30 is provided at the top end with a seat slot 31, two ribs 32, and a support plate 33 mounted on the ribs 32 and provided with two through holes 34 and 35. The support plate 33 is greater in size than the seat 30 and is disposed over a mounting hole 41 of a basin 40.

The locating plate 50 is disposed under the mounting hole 41 of the basin 40 and is provided with two retaining slots

51 opposite to each other for retaining the two ribs 32 of the water mixing bolt seat 30. The locating plate 50 is provided in the center with a threaded through hole 52 in alignment with the first through hole 34 of the water mixing bolt seat 30.

The water mixing bolt tube 60 is provided at both ends with a plurality of washers 61, in the midsegment with an outer threaded portion 62, and in the interior with a through hole 63 extending along the longitudinal direction thereof. The water mixing bolt tube 60 is further provided at the top end with an engagement slot 64 engageable with a hand tool. The water mixing bolt tube 60 is joined with the water mixing bolt seat 30 such that the water mixing bolt tube 60 is put through the first through hole 34 of the support plate 33, and that the outer threaded portion 62 is engaged with the threaded through hole 52 of the locating plate 50, and further that the bottom end of the water mixing bolt tube 60 is received in the seat slot 31 of the top end of the seat 30. As the water mixing bolt tube 60 is turned, the locating plate 50 is moved upwards to press against the bottom edge of the mounting hole 41 of the basin 40, so as to locate the water mixing bolt tube 60.

The locating bolt 70 has a head 71, a shank 72, a retaining slot 73, a center through hole 75, and an engagement slot 76 located at the top end of the through hole 75 to engage a hand tool. The locating bolt 70 is put through the second through hole 35 of the support plate 33 such that the head 71 is stopped at the bottom edge of the second through hole 35, and that a retaining ring 74 is received in the retaining slot 73, and further that a lift rod 42 of the basin 40 is put through the through hole 75 of the locating bolt 70.

The faucet neck 80 is provided at the inner end with a connection slot 81 and a locating slot 82. The connection slot 81 is connected with a water discharging channel 83, which is connected with the through hole 63 of the water mixing blot tube 60. The inner end of the facet neck 80 is mounted on the support plate 33. The locating slot 82 is provided with an inner threaded portion 84, which is engaged with the shank 72 of the locating bolt 70. As the locating bolt 70 is turned with a hand tool which is engaged with the engagement slot 76 of the locating bolt 70, the faucet neck 80 is forced downwards such that the inner end of the faucet net 80 is mounted securely in place on the support plate 33.

The present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A lavatory faucet comprising:

a water mixing bolt seat connected with a cold water control valve and a hot water control valve, said water mixing bolt seat provided at a top end with a seat slot, two ribs extending from the top end, and a support plate mounted on said two ribs and provided with a first through hole and a second through hole, said support plate being disposed over a mounting hole of a lavatory basin;

a locating plate disposed under the mounting hole, of the lavatory basin and provided with two retaining slots for accepting said two ribs of said water mixing bolt seat, said locating plate further provided with a threaded through hole in alignment with said first through hole of said water mixing bolt seat;

a water mixing bolt tube provided in a midsegment with an outer threaded portion, an interior with a longitudinal through hole, and at a top end with an engagement slot engageable with a hand tool, said water mixing bolt tube being joined with said water mixing bolt seat such that said water mixing bolt tube is put through said first through hole of said support plate, and that said outer threaded portion of said water mixing bolt tube is engaged with said threaded through hole of said locating plate, and further that a bottom end of said water mixing bolt tube is received in said seat slot of the top end of said water mixing bolt seat whereby said water mixing bolt tube is located by turning said water mixing bolt tube with the hand tool, thereby causing said locating plate to move to press against the bottom edge of surrounding said mounting hole the lavatory basin;

a locating bolt having a head, a shank, a retaining slot located in said shank for retaining a retaining ring, a center through hole extending along the longitudinal direction thereof, and an engagement slot located at a top end of said center through hole to engage a hand tool, said locating bolt being put through said second through hole of said support plate each that said head is stopped at a bottom surrounding said second through hole of said support plate, and that a lift rod of the lavatory basin is put through said center through hole of said locating bolt; and a faucet neck provided at an inner end with a connection slot and a locating slot, said faucet neck further provided with a water discharging channel connected with said connection slot and said longitudinal through hole of said water mixing bolt tube, said locating slot of said faucet neck provided with an inner threaded portion, said inner end of said faucet neck being mounted on said support plate such that said inner threaded portion of said locating slot is engaged with said shank of said locating bolt whereby said locating bolt is turned with the hand tool to cause said faucet neck to move downwards such that said inner end of said faucet neck is located securely on said support plate.

* * * * *